US007755598B2

(12) United States Patent
Yang et al.

(10) Patent No.: US 7,755,598 B2
(45) Date of Patent: Jul. 13, 2010

(54) IMAGE PROCESSING METHOD FOR DISPLAY DEVICE

(75) Inventors: Sun-Chen Yang, Taipei City (TW); Yii-Lin Wu, Taipei City (TW); Hsiang-Jui Hung, Taipei City (TW)

(73) Assignee: ASUSTeK Computer Inc., Peitou, Taipei (TW)

( * ) Notice: Subject to any disclaimer, the term of this patent is extended or adjusted under 35 U.S.C. 154(b) by 763 days.

(21) Appl. No.: 11/657,602

(22) Filed: Jan. 25, 2007

(65) Prior Publication Data

US 2007/0171183 A1 Jul. 26, 2007

(30) Foreign Application Priority Data

Jan. 26, 2006 (TW) ..... 95103152 A

(51) Int. Cl.
*G09G 5/00* (2006.01)

(52) U.S. Cl. ..... 345/102; 345/87; 345/204

(58) Field of Classification Search ..... 345/48, 345/63, 77, 84, 87, 204; 382/168, 254, 274, 382/276; 348/254, 672, 673; 358/522
See application file for complete search history.

(56) References Cited

U.S. PATENT DOCUMENTS 5,235,434 A 8/1993 Wober
5,963,665 A * 10/1999 Kim et al. ..... 382/169
6,762,567 B2 7/2004 Ide
6,873,742 B2 * 3/2005 Schu ..... 382/274
7,003,153 B1 * 2/2006 Kerofsky ..... 382/168
2003/0169248 A1 * 9/2003 Kim et al. ..... 345/204
2004/0036704 A1 2/2004 Han et al.
2005/0100242 A1 * 5/2005 Trifonov et al. ..... 382/274
2005/0265626 A1 * 12/2005 Endo et al. ..... 382/274
2006/0013503 A1 * 1/2006 Kim ..... 382/276
2006/0151678 A1 * 7/2006 Shibata ..... 250/205

FOREIGN PATENT DOCUMENTS

JP 4-289984 10/1992
JP 2000-122598 4/2000

OTHER PUBLICATIONS

Yeong-Taeg Kim, IEEE Transactions on Consumer Electronics, vol. 43, No. 1, Feb. 1997, pp. 1-8.

* cited by examiner

*Primary Examiner*—Amare Mengitsu
*Assistant Examiner*—Vince E Kovalick
(74) *Attorney, Agent, or Firm*—Winston Hsu

(57) ABSTRACT

The present invention provides an image processing method for a display device. The method includes: calculating an average brightness of an image; adjusting the average brightness to generate an adjusted average brightness; utilizing Brightness Preserving Bi-Histogram Equalization (BBHE) and the adjusted average brightness to process the image; and displaying the image.

3 Claims, 3 Drawing Sheets

| AL & BL | Bright | Middle | Dark |
| --- | --- | --- | --- |
| Setting Value | V1 | V2 | V3 |

Fig. 2

IMAGE PROCESSING METHOD FOR DISPLAY DEVICE

BACKGROUND OF THE INVENTION

1. Field of the Invention

The present invention relates to an image processing and display method, and more particularly, to a method utilizing Brightness Preserving Bi-Histogram Equalization (BBHE) to process images for improvement of image quality under various conditions of the ambient light.

2. Description of the Prior Art

Flat panel display devices have recently increased in popularity, among which include plasma display panel (PDP) devices and liquid crystal displays (LCD). For portable devices, a small-scale or middle-scale flat display device is usually applied. The display device must be able to adjust the brightness of the backlight in order to display a discernable image under various conditions of the ambient light in the environment. This is because a portable device will encounter various ambient light conditions depending on the current operating environment. However, the adjustment of brightness for the backlight may result in a decreased overall image quality for the display device. The related prior art provides a method for improving poor image quality by displaying more bits in the display device while decreasing the brightness of the backlight. For example, the number of bits is increased from eight bits to ten bits to compensate for problems caused by dimness of the backlight, such as a low contrast, low chromatism, or low saturation etc., to improve the image quality and resolution. However, displaying an image with increased bits also increases cost.

Additionally, in U.S. Pat. No. 6,762,567, a driving device for a plasma display panel is disclosed. When the average brightness of the image is decreased by adjusting the backlight, the driving device changes the voltage level, width, and frequency of the voltage driving pulse signal to improve the degraded image quality caused by the adjustment to the average brightness. However, increasing the width and frequency of the pulse not only results in more power consumption, but also degrades overall uniformity of the panel.

SUMMARY OF THE INVENTION

Therefore one of the objectives of the present invention is to provide an image processing method to improve image quality in a display device.

According to an embodiment of the claimed invention, an image processing method for a display device is disclosed. The method comprises: calculating an average brightness of an image; adjusting the average brightness to generate an adjusted average brightness; and utilizing Brightness Preserving Bi-Histogram Equalization (BBHE) and the adjusted average brightness to process the image.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

FIG. 2 is a table showing setting values corresponding to different conditions of ambient light and backlight settings.

DETAILED DESCRIPTION

According to an embodiment of the present invention, Brightness Preserving Bi-Histogram Equalization (BBHE) is utilized in a display device to compensate for decreased image quality upon the occurrence of a backlight adjustment when changed in response to ambient light. BBHE was first proposed in 1997 by Yeong-Taeg Kim proposed to improve original histogram equalization. Further details regarding BBHE can be found from the publication "Contrast Enhancement Using Brightness Preserving Bi-Histogram Equalization" by Y. T. Kim, IEEE Transactions on Consumer Electronics, vol. 43, No. 1, February 1997. While the original histogram equalization is used, the average brightness of the output image is independent of the average brightness of the unprocessed image. The average brightness of the output image can be represented through the following:

$$E(Y) = \frac{X_0 + X_{L-1}}{2} \qquad \text{Equation (1)}$$

where E(Y) is the average brightness level, $X_0$ is the minimum gray-level of the unprocessed image, and $X_{L-1}$ is the maximum gray-level of the unprocessed image.

However in BBHE, the average brightness of the output image includes information of the average brightness of the unprocessed image. The average brightness is shown below as:

$$E(Y) = \frac{1}{2}\left(X_m + \frac{X_0 + X_{L-1}}{2}\right) \qquad \text{Equation (2)}$$

where $X_m$ represents the average brightness of the unprocessed image.

Therefore, while the display device executes firmware supporting the above-mentioned BBHE, the average brightness of the unprocessed image, i.e. $X_m$, is multiplied by a brightness adjustment parameter B to change the average brightness of the final output image and improve image quality. The new mapped image (Y') is represented in the following:

$$Y' = \begin{cases} X_0 + (X'_m - X_0)c'_L(x); & \text{for } x \le X'_m \\ X'_{m+1} + (X_{L-1} - X'_{m+1})c'_u(x); & \text{others} \end{cases}$$

where $X_m' = B \times X_m$, $X_{m+1} = B \times X_{m+1}$, and $c_L$ and $c_U$ are cumulative density functions. As a result, the mapped image can be changed by controlling the brightness adjustment parameter B.

Aside from utilizing BBHE to improve image quality, the image can be further improved by simultaneously adjusting a gamma value corresponding to the image. Adjustment of the gamma value is well known to those skilled in the art, and is therefore not discussed here in further detail.

Figure 1:
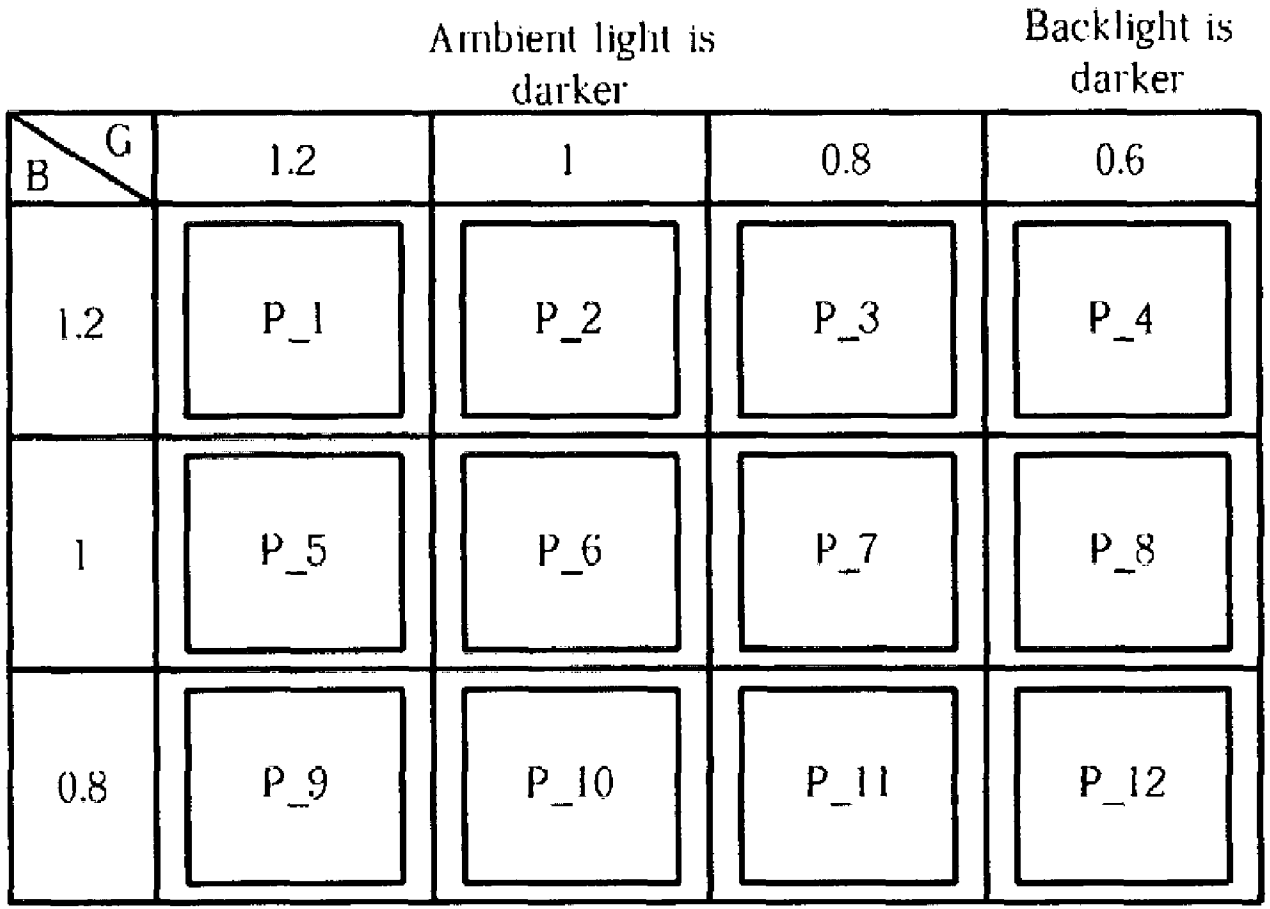
FIG. 1 is a table illustrating the relationship between gamma values and brightness adjustment parameters for an image under various ambient light and backlight conditions.

Under different conditions of ambient light and backlight settings, multiple sets of gamma values (G) and brightness adjustment parameters can be deduced for adjustment of the image. Please refer to FIG. 1. FIG. 1 is a table illustrating the relationship between gamma values (G) and brightness adjustment parameters (B) of an image under a certain condition of the ambient light and backlight (for example, the ambient light and backlight being darker). In this example, the gamma values are set at 0.6, 0.8, 1.0, and 1.2, and the brightness adjustment parameters are set at 0.8, 1.0, and 1.2. The combination of each gamma value and brightness adjustment parameter described above corresponds to images P_1~P_12 respectively. The images with better quality are selected, with the gamma value and brightness adjustment parameter corresponding to the better images being recorded. More gamma values and brightness adjustment parameters corresponding to better images can be found and recorded under different conditions of ambient light and backlight according to the above-described method.

Please refer to FIG. 2. FIG. 2 is a table illustrating setting values corresponding to different conditions of ambient light (AL) and backlight (BL) settings. As shown in FIG. 2, each combination of ambient light and backlight (i.e. bright, middle, and dark) corresponds to each respective setting value (i.e. V1, V2, and V3). Each setting value comprises a gamma setting value and a brightness adjustment parameter. In this embodiment, the conditions for ambient light and backlight (i.e. bright, middle, and dark) are only supplied for illustrative purposes. Additional setting values can be utilized to accurately describe the various conditions of the ambient light and backlight which may occur in practice. Therefore, additional setting values can be referenced to adjust the image for improvement of image quality.

Figure 3:
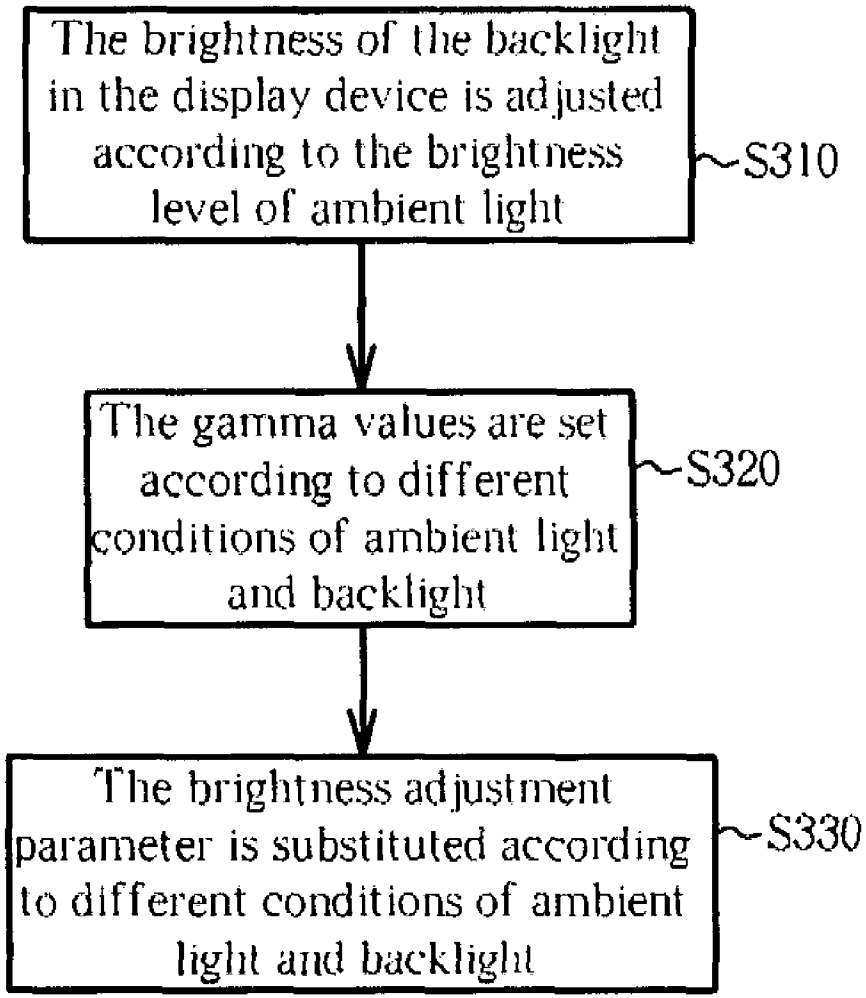
FIG. 3 is a flowchart illustrating the image processing method in a display device according to an embodiment of the present invention.

Please refer to FIG. 3. FIG. 3 is a flowchart illustrating the image processing method for a display device according to the embodiment of the present invention. As shown in FIG. 3, the brightness of the backlight in the display device is adjusted according to the brightness level of ambient light (step S310). The setting values which correspond to different conditions of ambient light and backlight, are first selected. The gamma values of the image are then set according to the gamma setting values of the setting values (step S320). Finally, the brightness adjustment parameter in the setting values is substituted into BBHE to improve the brightness of the image (step S330).

In summary, the embodiment of the present invention improves image brightness through a brightness adjustment parameter so that a degraded image quality caused by a change in backlight and/or ambient light conditions can be compensated for. Moreover, the quality of the image can be further improved according to the adjustments of gamma values. Using the method provided in the embodiment of the present invention, an improve image quality will result regardless of adjustments to backlight display brightness and various ambient light conditions.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An image processing method for a display device comprising:

calculating an average brightness of an image;

adjusting a brightness of a backlight of the display device;

selecting a specific setting value from a plurality of setting values according to the brightness of the backlight of the display device and a brightness of an ambient light of the display device, wherein the specific setting value comprises a gamma setting value and an average brightness adjustment parameter;

adjusting a gamma value corresponding to the image according to the gamma setting value to set the gamma value;

adjusting the average brightness to generate an adjusted average brightness; and utilizing the adjusted average brightness substituted into Brightness Preserving Bi-Histogram Equalization (BBHE) to process the image.

2. The image processing method of claim 1, further comprising:

adjusting the average brightness to generate an adjusted average brightness according to an average brightness of the unprocessed image and a brightness adjustment parameter B.

3. The image processing method of claim 1, wherein the display device is a flat panel display device or a liquid crystal display (LCD) device.

* * * * *